US007353811B2

(12) United States Patent
Weisz

(10) Patent No.: US 7,353,811 B2
(45) Date of Patent: Apr. 8, 2008

(54) EXHAUST GAS RECIRCULATION DEVICE

(75) Inventor: Rafael Weisz, Waiblingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 11/703,552

(22) Filed: Feb. 7, 2007

(65) Prior Publication Data

US 2007/0199549 A1 Aug. 30, 2007

(30) Foreign Application Priority Data

Feb. 24, 2006 (DE) ..... 10 2006 009 153

(51) Int. Cl.
*F02M 25/07* (2006.01)
*F02M 25/00* (2006.01)

(52) U.S. Cl. ..... 123/568.17; 123/568.18; 123/568.21

(58) Field of Classification Search ..... 123/568.17, 123/568.18, 568.19, 568.21, 568.23, 568.24, 123/568.11

See application file for complete search history.

(56) References Cited

U.S. PATENT DOCUMENTS 5,611,204 A * 3/1997 Radovanovic et al. ..... 60/605.2
6,343,594 B1 * 2/2002 Koeslin et al. ..... 123/568.17
6,425,356 B1 * 7/2002 Pischinger et al. ..... 123/90.15
6,502,397 B1 1/2003 Lundqvist
6,886,544 B1 * 5/2005 Bui ..... 123/568.18
6,886,545 B1 * 5/2005 Holm ..... 123/568.21
7,036,529 B2 * 5/2006 Berggren et al. ..... 137/892
7,040,305 B2 5/2006 Sponton
2004/0007220 A1 * 1/2004 Sponton ..... 123/568.18
2004/0099257 A1 * 5/2004 Berggren et al. ..... 123/568.17
2006/0124116 A1 * 6/2006 Bui ..... 123/568.18

FOREIGN PATENT DOCUMENTS

DE 44 29 232 C1 9/1995
WO WO 01/90559 A1 11/2001

* cited by examiner

*Primary Examiner*—Mahmoud Gimie
(74) *Attorney, Agent, or Firm*—Collard & Roe, P.C.

(57) ABSTRACT

An exhaust gas recirculation device for an internal combustion engine, in particular in a motor vehicle, includes a recirculation line and a fresh gas line section. A Venturi nozzle is designed in an inlet area of the fresh gas line section. The recirculation line opens into the fresh gas line section in a low pressure area of the Venturi nozzle. The Venturi nozzle has a variable flow cross section to allow exhaust gas recirculation in the largest possible operating range of the internal combustion engine.

12 Claims, 4 Drawing Sheets

EXHAUST GAS RECIRCULATION DEVICE

CROSS REFERENCE TO RELATED APPLICATIONS

Applicant claims priority under 35 U.S.C. §119 of German Application No. 10 2006 009 153.1 filed Feb. 24, 2006.

BACKGROUND OF INVENTION

Field of the Invention

The present invention relates to an exhaust gas recirculation device for an internal combustion engine, in particular in motor vehicle.

PRIOR ART

DE 44 29 232 C1 describes an exhaust gas recirculation device which has a recirculation line and is equipped with a fresh gas line section. A Venturi nozzle is provided in an inlet area of the fresh gas line section. The recirculation line is connected to the fresh gas line section so that it opens into a low pressure area of the Venturi nozzle.

In particular with supercharged internal combustion engines, the pressure in the fresh gas line in many operating ranges of the internal combustion engine may be higher than the pressure in the exhaust line. Exhaust gas recirculation is then impossible without additional measures. By using a Venturi nozzle, the pressure in the fresh gas line can be lowered locally, so that there is an adequate pressure gradient between the exhaust gas line and the fresh gas line to allow the desired exhaust gas recirculation.

However, the desired local reduction in pressure can be achieved with a Venturi nozzle only if the velocities of flow prevailing therein are relatively high, e.g., greater than 0.65 Mach. In addition, the throughput through a Venturi nozzle is limited to the flow rate established on reaching the velocity of sound. Therefore, the design of the Venturi nozzle must take into account the maximum required flow rate of fresh gas. At a low engine speed and/or at a low load, the velocity of flow in the Venturi nozzle is reduced to such an extent that in many applications the pressure drop required for intake of the exhaust gas is not achieved.

U.S. Pat. No. 6,502,397 B1 describes another exhaust gas recirculation device that operates with a Venturi nozzle. A mouth section of the recirculation line there is arranged coaxially with the Venturi nozzle and is mounted axially adjustably on the fresh gas line section. By axial positioning of the mouth opening of the recirculation line in relation to the Venturi nozzle, the pressure prevailing at the mouth opening can be varied. The recirculation rate can be adjusted in this way. However, even with this embodiment, the Venturi nozzle is to be designed for the maximum required fresh gas flow rate.

The present invention relates to the problem of providing an improved embodiment for an exhaust gas recirculation device of the type defined above, characterized in particular in that it operates reliably in a comparatively large operating range of the internal combustion engine and allows an adequate, preferably adjustable exhaust gas recirculation rate.

This problem is solved according to this invention by the subject matter disclosed herein. A number of advantageous embodiments are described.

The invention is based on the general idea of designing the Venturi nozzle with a variable nozzle geometry such that the narrowest flow cross section of the Venturi nozzle can be varied, i.e., is adjustable. For high fresh gas flow rates, a comparatively large flow cross section can thus be adjusted to adjust the desired pressure drop in flow-through close to the velocity of sound and thus to adjust the respective desired recirculation rate. With small fresh gas flow rates, the flow cross section can be narrowed accordingly so that here again velocities of flow near the velocity of sound can be implemented. Accordingly, even with relatively small flow rates, it is possible to adjust an adequate pressure drop in the Venturi nozzle to achieve the particular exhaust gas recirculation rate desired. To this extent, the variable Venturi nozzle makes it possible to achieve the pressure drop in the Venturi nozzle required for implementation of the particular exhaust gas recirculation rate desired and to do so over a large operating range of the internal combustion engine, preferably over the entire operating range. The exhaust gas recirculation device therefore becomes more efficient and improves the emissions of the internal combustion engine equipped therewith over a larger operating range.

The adjustability of the flow cross section can be implemented essentially in various ways with the Venturi nozzle. In a preferred embodiment, the Venturi nozzle has at least one adjustable wall section which is adjustable with regard to its distance with respect to an opposing wall section. The flow cross section of the Venturi nozzle can be adjusted by varying the distance measured across the direction of flow of the Venturi nozzle. An embodiment with such an adjustable wall section can be implemented comparatively inexpensively.

Additional important features and advantages of the invention will become apparent from the following detailed description considered in connection with the accompanying drawings.

It is self-evident that the features mentioned above and those yet to be explained below may be used not only in the particular combination given but also in other combinations or alone without going beyond the scope of the present invention.

BRIEF DESCRIPTION OF THE DRAWINGS

Preferred exemplary embodiments of the present invention are depicted in the drawings and explained in greater detail in the following description, where the same reference numerals refer to the same or similar or functionally identical components.

The drawings show schematically in each case

DETAILED DESCRIPTION OF THE DRAWINGS

Figure 1:
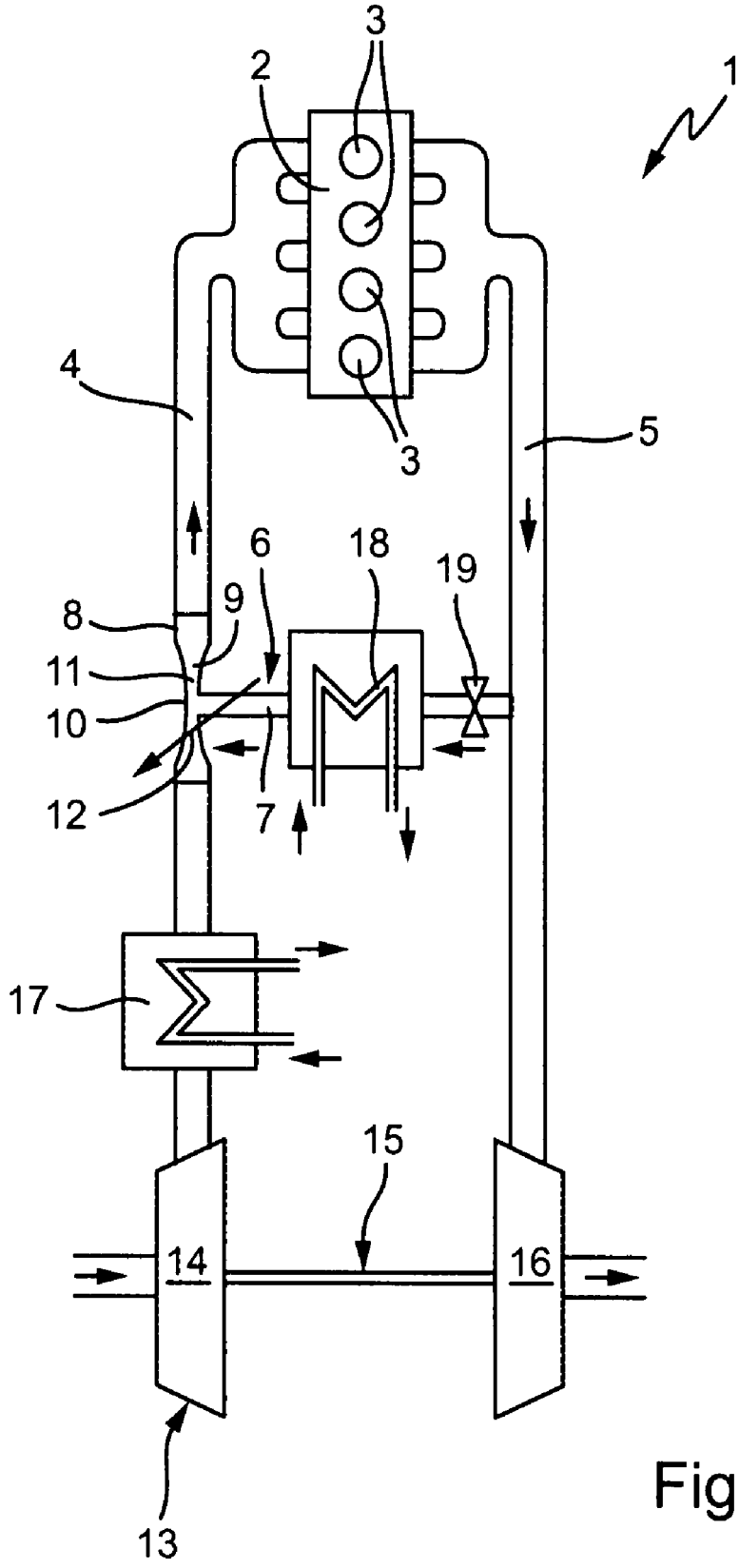
FIG. 1 a basic diagram like a wiring diagram of an internal combustion engine having exhaust gas recirculation, FIG. 2 a partial sectional perspective view of an exhaust gas recirculation device, FIG. 3 a view like that in FIG. 2 but from a different direction of view, FIGS. 4 to 6 views like that in FIG. 2 but each showing different embodiments.

According to FIG. 1, an internal combustion engine 1, in particular in a motor vehicle, comprises an engine block 2 having multiple cylinders 3. The internal combustion engine 1 has a fresh gas line 4 which supplies fresh gas to the cylinders 3. In addition, an exhaust gas line 5 is provided, carrying exhaust gas away from the cylinders 3. The internal combustion engine 1 is equipped with an exhaust gas recirculation device 6 having a recirculation line 7 and a fresh gas line section 8. The fresh gas line section 8 is installed in the fresh gas line 4 in the installed state illustrated here. The recirculation line 7 in the installed state shown here connects the exhaust line 5 to the fresh gas line section 8.

In the fresh gas line section 8, an inlet area 9 where a Venturi nozzle 10 is provided is provided for the exhaust gas inlet. The recirculation line 7 is connected to the fresh gas line section 8 so that the recirculation line 7 opens into the fresh gas line section 8 in a low pressure range 11 of the Venturi nozzle 10. According to this invention, the Venturi nozzle 10 is designed so that it has a variable flow cross section, which is represented by the arrow 12 in FIG. 1.

The internal combustion engine 1 is preferably a supercharged combustion engine 1, e.g., a diesel engine or a gasoline engine having a charging device, i.e., a charger 13 in the fresh gas line 4. In the exemplary embodiment shown here, the charger 13 is a compressor 14 of an exhaust gas turbocharger 15 whose turbine 16 is installed in the exhaust line 5. Essentially, however, another embodiment of the charger 13 is possible, e.g., a mechanically driven compressor, in particular a roots blower.

Downstream from the charger 13 a charging air cooler 17 may be provided in the fresh gas line 4. Upstream from the fresh gas line section 8, an exhaust gas recirculation cooler 18 may be arranged in the recirculation line 7. In addition, the recirculation line 7 e.g., the exhaust gas recirculation cooler 18, may contain a cutoff valve 19.

According to FIGS. 2 through 6, the exhaust gas recirculation device 6 may be equipped with a control device 20 for implementation of the adjustability of the narrowest flow cross section of the Venturi nozzle 10. The control device 20 may be an electric motor, in particular a stepping motor, or any other actuator that may operate electrically, pneumatically, hydraulically, and/or pneumatically.

To be able to vary the flow cross section, the Venturi nozzle 10 may have at least one adjustable wall section 21 according to the embodiment shown here. The adjustable wall section 21 is adjustable with respect to its distance with respect to an opposing wall section 22. In the examples shown here, the wall section 22 mentioned last is fixed and is therefore referred to below as fixed wall section 22. The distance between the adjustable wall section 21 and the fixed wall section 22 is measured across the direction of flow 23 of the Venturi nozzle 10. This direction of flow 23 is represented here by an arrow. The wall sections 21, 22 of the Venturi nozzle 10 form a Venturi nozzle profile in the direction of flow 23, said profile initially converging and then diverging. In this way, a variable flow cross-sectional area is obtained in the direction of flow 23. In the exemplary embodiments shown here, the Venturi nozzle 10 has essentially a rectangular profile across its direction of flow 23. This design simplifies the implementation of the variable flow cross section by means of the adjustable wall section 21. The wall sections 21, 22 are bordered laterally, i.e., across the direction of flow 23 by side walls 24, only one of which is discernible in the sectional views shown here. These side walls 24 may be planar to be able to adjust the adjustable wall section 21 comparatively tightly along the side walls 24 across the direction of flow 23.

Figure 2:
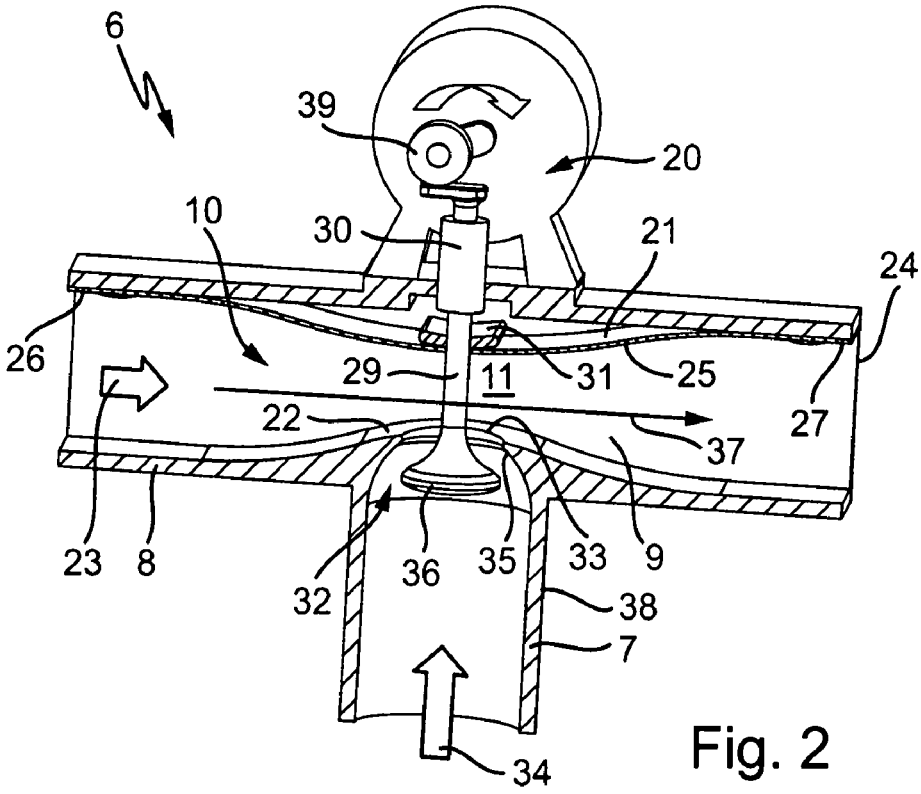
Figure 3:
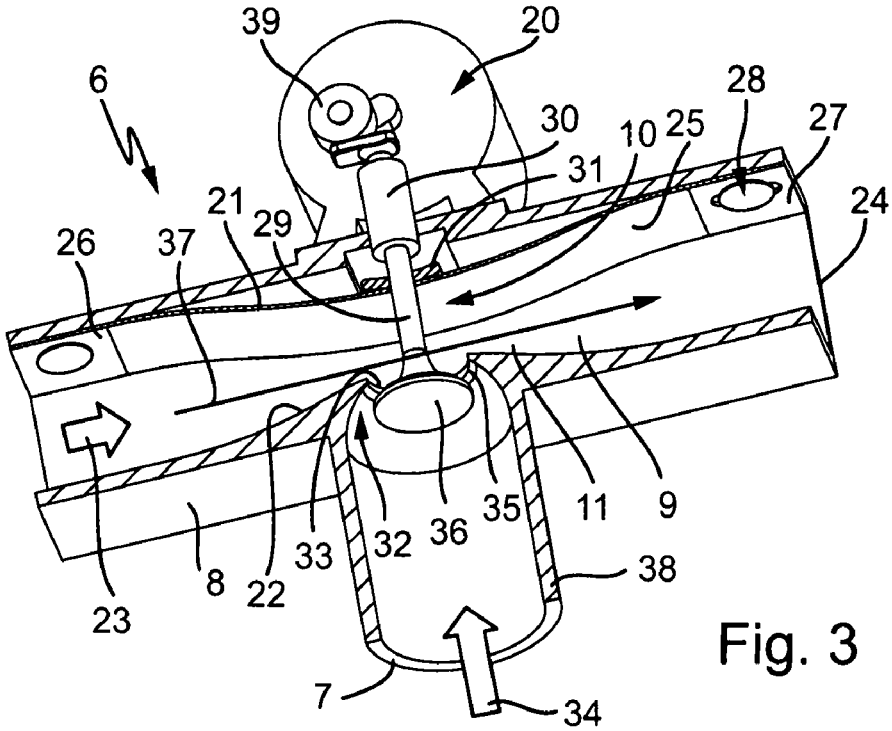

With the embodiment shown in FIGS. 2 and 3, the adjustable wall section 21 is formed by a membrane 25 that is elastically bendingly deformable membrane 25. The membrane 25 which may be made of steel plate, for example, is attached to the fresh gas line section 8 at its end sections 26, 27 which are spaced a distance apart in the direction of flow 23. At least one of these end sections 26, 27, namely the downstream end section 27 here, is attached to the fresh gas line section 8 so that it is displaceable in the direction of flow 23 in relation to the fresh gas line section 8. This displaceability may be achieved, for example, with the help of an elongated hole configuration 28, which is indicated in FIG. 3. The membrane 25 is shaped so that it automatically assumes a starting position in which the distance between the two wall sections 21, 22 is at the maximum. In this starting position, it is prestressed by its spring property. If the spring force of the membrane 25 is not sufficient, an additional spring may be installed, e.g., a cylindrical helical spring which acts on the membrane 25 or on the valve or control element 29 which is explained in greater detail below and in particular is arranged concentrically with the valve 29. At the same time, this starting position may be defined by the elongated hole configuration 28. The control device 21 can adjust the membrane 25 in the direction of the fixed wall section 22 so that the distance between the wall sections 21 and 22 is reduced. The minimum adjustable distance is again defined by the elongated hole configuration 28.

To this end, the control mechanism 20 is drive-coupled to the adjustable wall section 21. To do so, the control mechanism 20 has a control element 29 which is designed here in the manner of a valve rod as an example. The control member 29 is drive-coupled to the membrane 25 by means of an entraining element 30 which cooperates here with an entraining plate 31. The entraining plate 31 is mounted on the membrane 25 and together with the entraining element 30 forms an entraining arrangement.

In the example shown here the entraining arrangement 30, 31 may be designed so that it has a predetermined return stroke. This means that the control element 29 must perform the return stroke only before its stroke adjustment results in an adjusting movement of the membrane 25. In the embodiment shown here, the return stroke is utilized to actuate a cut-off valve 32 with the help of which the recirculation line 7 can be blocked and/or opened. In the exemplary embodiment shown here, a mouth opening 33 of the recirculation line 7 is situated in the fixed wall section 2. The recirculated exhaust gas, represented by an arrow 34, goes through the mouth opening 33 into the Venturi nozzle 10. A valve seat 35 of the cut-off valve 32 is designed in the area of the mouth opening 33, cooperating with a valve member 36. The recirculation line 7 is blocked and the exhaust gas circulation is deactivated when the valve element 36 is retracted into its valve seat 35.

Essentially, said cut-off valve 32 may be designed completely independently of the control mechanism 20. With the special embodiment shown in FIGS. 2 and 3, however, the valve member 36 on the control member 29 of the control mechanism 20 is designed so that the cut-off valve 32 can be activated via the control member 20 simultaneously. To be able to open the cut-off valve 32 at the maximum flow cross section of the Venturi nozzle 10, the return stroke defined above is required.

The control member 29 is adjustable in stroke in the direction of the distance between the two wall sections 21, 22, i.e., across the flow direction 23. In addition, the control member 29 here penetrates through the membrane 25 and extends through the mouth opening 33 in its stroke direction up to and into the recirculation line 7. Accordingly, the control member 29 crosses through a flow path 37, also represented by an arrow, leading through the Venturi nozzle 10.

In the embodiment illustrated in FIGS. 2 and 3, the recirculation line 7 has a mouth section 38 which opens into the fresh gas line section 8 and together with the fresh gas line 8 may form an integral component. This mouth section 38 here has a longitudinal direction running essentially across the direction of flow 23. The mouth opening 33 here is arranged in the central section of the Venturi nozzle 10 and is therefore situated in the area of the narrowest flow cross section of the Venturi nozzle 10. The relative position between the mouth opening 33 inside the Venturi nozzle 10 is stationary, i.e., invariant.

For adjusting the stroke of the control member 29, the control mechanism 20 may have a cam 39 to convert a rotational movement, e.g., of a rotary actuator into the lifting movement of the control member 29.

For emergency operation of the internal combustion engine 1, the exhaust gas recirculation device 6 may be equipped with a fail-safe function which adjusts a minimum exhaust gas recirculation rate, in particular at a value of zero, for the exhaust gas recirculation, e.g., by adjusting the Venturi nozzle 10 for maximum flow cross section and/or for minimum pressure drop and by operating in particular the cut-off valve 19 and/or 32 for cutting off the recirculation line 7.

Figure 4:
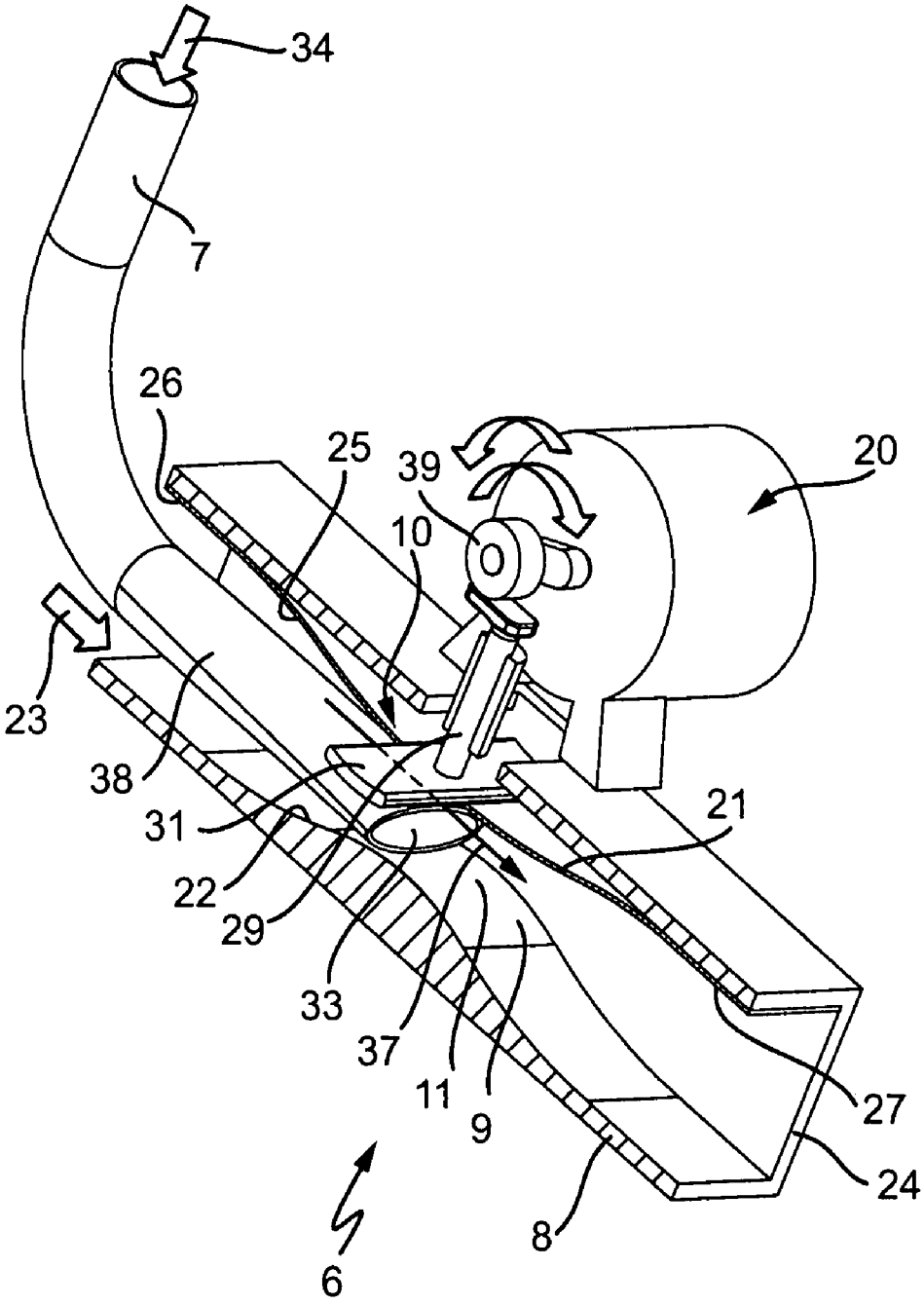
Figure 5:
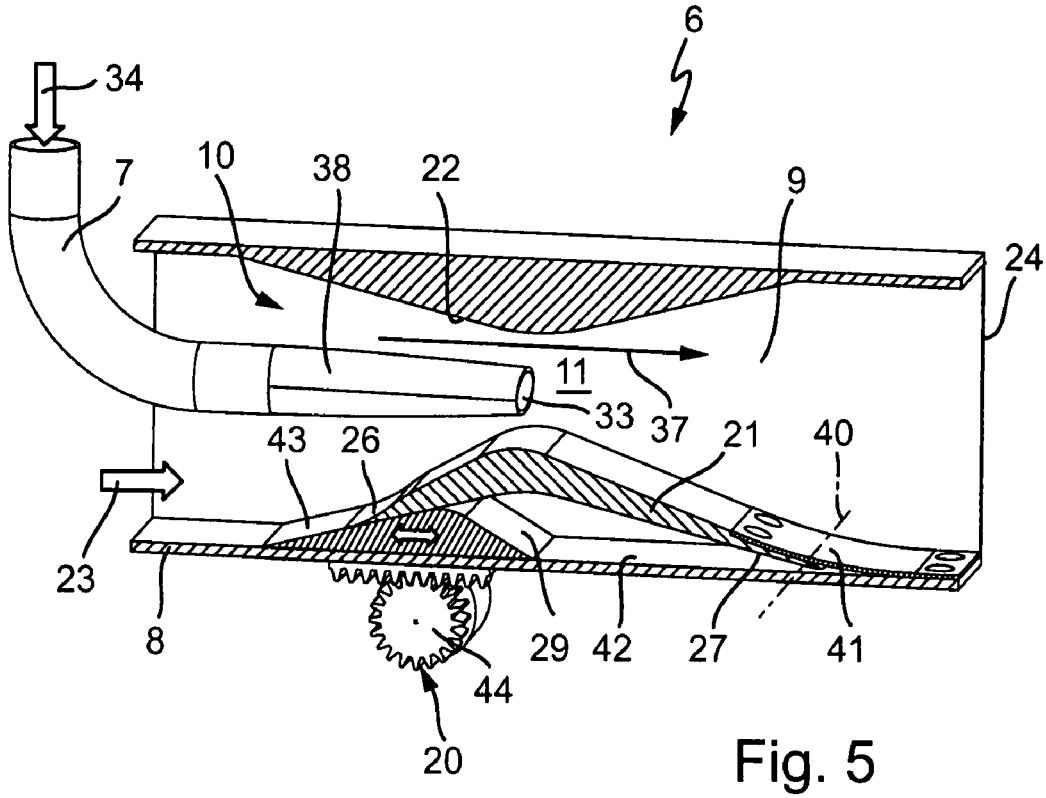
Figure 6:
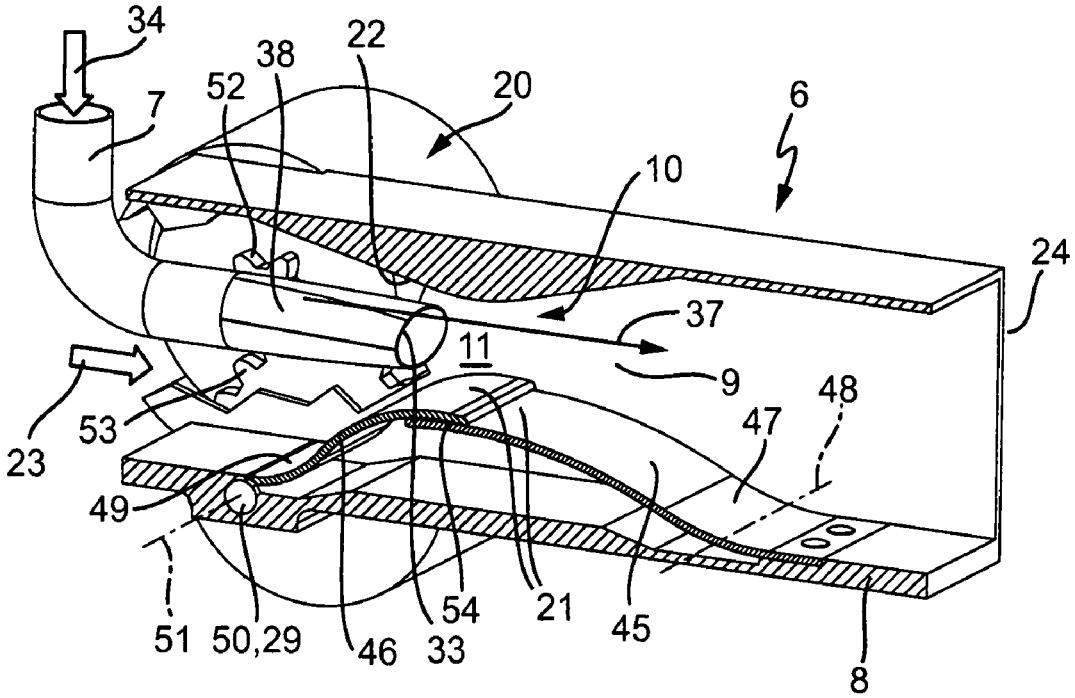

In the embodiments illustrated in FIGS. 4 through 6, the mouth section 38 of the recirculation line 7 opening into the fresh gas line 8 is arranged in a stationary mount in the interior of the fresh gas line section 8, preferably in such a way that the longitudinal direction of the mouth section 38 extends essentially parallel to the direction of flow 23. In addition, the mouth section 38 is arranged in the fresh gas line section 8 so that the mouth opening 33 is open axially and in the direction of flow 23. In addition, the arrangement of the mouth section 38 is such that here again the mouth opening 33 is in the area of the narrowest flow cross section of the Venturi nozzle 10. The mouth section 38 may have a cross-sectional profile which is elliptical in the mouth opening 33 and develops continuously into a circular profile upstream. In this way, the mouth section 38 is adapted to the rectangular profile of the Venturi nozzle 10 in the area of the mouth opening 33.

In the embodiment shown in FIG. 4, the control member 29 is arranged exclusively on a side of the membrane 25 facing away from the flow path 37. In other words, the control member 29 does not protrude into the flow path 37 and therefore does not lead to a disturbance in the fresh gas flow in the fresh gas line section 8. Here again, the control member 29 is supported on the membrane 25 over a large area via an entraining plate 31.

According to FIG. 5, the adjustable wall section 21 may be pivotably mounted on the fresh gas line section 8 at one of its end sections 26, 27, namely here on the downstream end section 27, so that it is pivotable essentially about a pivot axis 40 running across the direction of flow. The adjustable wall section 21 may therefore be designed in said end section 27 as an elastic membrane or it may be attached to the fresh gas line section 8 via an elastic membrane 41. The pivot axis 40, the spatial position of which may change during the pivot adjustment of the wall section 21, is obtained due to the bending deformation of the membrane 41 and/or the membrane-like end section 27. Likewise, for pivotable mounting of the wall section 21 on the fresh gas line section 8, use of a hinge is possible, providing a pivot axis 40 defined in a spatially fixed position. The adjustable wall section 21 is preferably comparatively massive, but in particular is designed to be rigid or stiff.

The drive coupling of the adjustable wall section 21 to the adjusting device 20 is performed in the area of the other end section 26, i.e., the upstream end section here. To do so, the control member 29 in the present case is designed in the form of a wedge and is adjustable in relation to the fresh gas line section 8 in the manner of a slide along a planar wall 42 of the fresh gas line section 8 and thus is adjustable in parallel with the direction of flow 23 in relation to the adjustable wall section 21. The wedge-shaped control member 29 has a ramp 43 on its side facing the flow path 37, the adjustable wall section 21 with its upstream end section 26 resting on said ramp and sliding along the ramp 43 during adjustment movements of the control member 29. For drive coupling of the control member 29 to the control drive 20, the latter has a gear wheel drive 44, for example. By adjusting the control member 29 in the direction of flow 23, the adjustable wall section 21 is pivoted about the pivot axis 40. Then the distance between the adjustable wall section 21 and the fixed wall section 22 changes.

According to FIG. 6, the adjustable wall section 21 in another embodiment may have at least two partial wall sections, namely a first partial wall section 45 and a second partial wall section 46 which overlap one another in the direction of flow 23. The first partial wall section 45 is arranged on an end section 47 which is at a distance from the second partial wall section 46 and which is arranged here at the outlet of the Venturi nozzle 10 and is pivotably attached to the fresh gas line section 8 to pivot about a pivot axis 48 running across the direction of flow 23. The first wall section 45 is formed by an elastic membrane, for example, e.g., made of steel plate. The pivotability about the pivot axis 48 is obtained here due to bending deformation of the membrane-like first partial wall section 45 in the area of the secured end section 47. Here again, as an alternative, a hinge having a defined pivot axis 48 may be provided.

The second partial wall section 46 is mounted in a rotationally fixed manner on a shaft 50 at an end section 49 which is at a distance from the first partial wall section 45 and is arranged here at the outlet of the Venturi nozzle 10. Said shaft 50 is mounted rotatably on the fresh gas line section 8 to rotate about an axis of rotation 51 extending across the direction of flow 23 and parallel to the pivot axis 48. The adjusting mechanism 20 is drive-coupled to the shaft 50, e.g., via gear wheels 52, 53 and thereby drives the second partial wall section 46 to execute pivoting adjustments with respect to the axis of rotation 51. Thus in this embodiment the shaft 50 forms the control member 29 of the control mechanism 20.

In an overlap area 54 the second partial wall section 46 is in contact with the first partial wall section 45 on a side that faces the flow path 37 and slides on it. The second partial wall section 46 here can entrain the first partial wall section 45 in pivoting, whereby the latter is pivoted about its pivot axis 48. In a rotational adjustment which leads to an increase in the distance between the wall sections 21, 22, the first partial wall section 45 is preferably pivoted against the spring force. In retracting the second partial wall section 46, the first partial wall section 45 may automatically follow due to said spring force.

The overlap area 54 may be arranged in the area of the narrowest flow cross section of the Venturi nozzle 10, i.e., essentially centrally, for example.

The inventive exhaust gas recirculation device 6 allows, first of all, an adjustment of the exhaust gas recirculation rate by adjusting the pressure drop in the low-pressure range 11 of the Venturi nozzle 10 accordingly by varying the (narrowest) flow cross section of the Venturi nozzle 10. Secondly, with the inventive exhaust gas recirculation device 6, adequate exhaust gas recirculation can be implemented with the inventive exhaust gas recirculation device 6 even with a comparatively small fresh gas volume flow by reducing the flow cross section of the Venturi nozzle 10 until velocities of flow that create the pressure drop required for the exhaust gas intake in the low pressure range 11 are established in the Venturi nozzle 10. The pressure drop in the Venturi nozzle 10 is adjusted so that the exhaust gas recirculation rate achieves the desired and/or required level. This level and other engine values may be stored as an engine characteristics map in the engine controller, for example.

The invention claimed is:

1. An exhaust gas recirculation device for an internal combustion engine (1), in particular in a motor vehicle having at least one recirculation line (7), having a fresh gas line section (8) in which a Venturi nozzle (10) is designed in an inlet area (9), the Venturi nozzle (10) having at least one adjustable wall section (21) which is adjustable with regard to its distance with respect to an opposite wall section (22), and having a cut-off valve (32) with a valve seat (35) for blocking and opening the at least one recirculation line (7), whereby the at least one recirculation line (7) opens into the fresh gas line section (8) through a mouth opening (33) disposed in a low pressure range (11) of the Venturi nozzle (10), wherein the Venturi nozzle (10) has a variable flow cross section and wherein the mouth opening (33) of the recirculation line (7) and the valve seat (35) of the cut-off valve (32) are arranged in the wall section (22) opposing the adjustable wall section (21) of the Venturi nozzle (10).

2. The exhaust gas recirculation device according to claim 1, wherein a control device (20) for adjusting the flow cross section of the Venturi nozzle (10) is provided.

3. The exhaust gas recirculation device according to claim 1, wherein the adjustable wall section (21) is formed by an elastically bendingly deformable membrane (25) which is attached to the fresh gas line section (8) on its end sections (26, 27) spaced a distance apart from one another in the direction of flow (23) of the Venturi nozzle (10), the membrane (25) is attached with at least one of its end sections (27) to the fresh gas line section (8) in the direction of flow (23) so that it is displaceable in relation to the fresh gas line section (8).

4. The exhaust gas recirculation device according to claim 2 wherein the control device (20) is drive-coupled to the adjustable wall section (21) and/or the control device (20) has a control member (29) that is drive-coupled to the membrane (25) and/or the control member (29) is arranged exclusively on a side of the membrane (25) facing away from the flow path (37) leading through the Venturi nozzle (10) and/or the control member (29) penetrates through the membrane (25) across the direction of flow (23) of the Venturi nozzle (10) and has a valve member (36) for controlling a mouth opening (33) of the recirculation line (7) and/or the control member (29) is adjustable in stroke across the direction of flow (23) of the Venturi nozzle (10) and/or the control member (29) is drive-coupled to the adjustable wall section (21) or to the membrane (25) via an entraining arrangement (30, 31) so that the control member (29) entrains the adjustable wall section (21) or the membrane (25) only after a predetermined return stroke.

5. The exhaust gas recirculation device according to claim 1, wherein the adjustable wall section (21) is attached to the fresh gas line section (8) 50 that it can pivot about a pivot axis (40) running across the direction of flow (23) of the Venturi nozzle (10) on an upstream or downstream end section (27) and/or the adjustable wall section (21) is stiff or rigid.

6. The exhaust gas recirculation device according to claim 2, wherein the control device (20) is drive-coupled to the adjustable wall section (21) in the area of the other end section (26) and/or the control device (20) has a wedge-shaped control member (29) that is adjustable parallel to the direction of flow (23) in relation to the fresh gas line section (8) and cooperates with the other end section (26) of the adjustable wall section (21) and pivots it more or less about the pivot axis (40) depending on its relative position.

7. The exhaust gas recirculation device according to claim 1, wherein the adjustable wall section (21) has two partial wall sections (45, 46) overlapping one another in the direction of flow (23) of the Venturi nozzle (10), the first partial wall section (45) is mounted on the fresh gas line section (8) 50 it can pivot about a pivot axis (48) running across the direction of flow (23) on an end section (47) at a distance from the second partial wall section (46), the second partial section (46) is attached to a shaft (50) on an end section (49) at a distance from the first partial wall section (45), said shaft being arranged on the fresh gas line section (8) to rotate about an axis of rotation (51) running across the direction of flow (43).

8. The exhaust gas recirculation device according to claim 2, wherein the control device (20) is drive-coupled to the shaft (50) and/or the second partial wall section (46) entrains the first partial wall section (45) in pivoting or entrains against the spring force and/or the second partial wall section (46) slides on the first partial wall section (45) in the overlap area (54) and/or the overlap area (54) is designed in the area of the narrowest flow cross section of the Venturi nozzle (10).

9. The exhaust gas recirculation device according to claim 1, wherein the at least one recirculation line (7) opens into the fresh gas line section (8) in the area of the narrowest flow cross section of the Venturi nozzle (10) and/or the at least one recirculation line (7) has a mouth section (38) opening into the fresh gas line section (8), its longitudinal direction running essentially across the direction of flow (23) of the Venturi nozzle (10) and/or the Venturi nozzle (10) has essentially a rectangular profile with a cross-sectional area that varies in the direction of flow (23) across its direction of flow (23).

10. The exhaust gas recirculation device according to claim 1, wherein the recirculation line (7) is connected to an exhaust line (5) of the internal combustion engine (1) upstream from a turbine (16) of the exhaust gas turbocharger (15) and/or the fresh gas line section (8) is installed in a fresh gas line (4) of the internal combustion engine (1) downstream from a charger (13), in particular a compressor (14) of an exhaust gas turbocharger (15).

11. An exhaust gas recirculation device for an internal combustion engine (1), in particular in a motor vehicle having at least one recirculation line (7) with a mouth section (38) having a mouth opening (33) open axially in a direction of flow (23), and having a fresh gas line section (8) in which a Venturi nozzle (10) is designed in an inlet area (9), the Venturi nozzle (10) having a variable flow cross section, wherein the at least one recirculation line (7) opens into the fresh gas line section (8) in a low pressure range (11) of the Venturi nozzle (10) and the mouth section (38) of the recirculation line (7) is arranged within the fresh gas line section (8) such that the mouth section (38) ends free or contactless in the fresh gas line section (8).

12. An exhaust gas recirculation device for an internal combustion engine, the exhaust gas recirculation device comprising:

a) a fresh gas line section having an inlet area;

b) a Venturi nozzle having a variable flow cross section disposed in said inlet area of said fresh gas line section, said Venturi nozzle comprising an adjustable wall section and an opposite wall section, said adjustable wall section being movable with respect to said opposite wall section;

c) a recirculation line opening into said fresh gas line section at a mouth opening, said mouth opening disposed in a low pressure range of said Venturi nozzle; and d) a cut-off valve having a valve seat for blocking and opening said recirculation line;

wherein said mouth opening and said valve seat are disposed in said opposite wall section.

* * * * *